US005803991A

United States Patent [19]

Tsubouchi et al.

[11] Patent Number: 5,803,991

[45] Date of Patent: Sep. 8, 1998

[54] CORROSION-RESISTANT METALLIC POROUS MEMBER AND METHOD OF MANUFACTURING THE SAME

[75] Inventors: Toshiyasu Tsubouchi; Satoru Okamoto; Tomohiko Ihara, all of Itami, Japan

[73] Assignee: Sumitomo Electric Industries, Ltd., Osaka, Japan

[21] Appl. No.: 712,549

[22] Filed: Sep. 11, 1996

Related U.S. Application Data

[62] Division of Ser. No. 493,461, Jun. 22, 1995, Pat. No. 5,582,867.

[30] Foreign Application Priority Data

Jun. 28, 1994 [JP] Japan ..... 6-146590

[51] Int. Cl.[6] ..... B01D 46/00

[52] U.S. Cl. ..... 148/280; 427/253; 55/523

[58] Field of Search ..... 148/280; 55/523, 55/525, 527; 210/509, 510.1; 427/253

[56] References Cited

U.S. PATENT DOCUMENTS

| | | | |
|---|---|---|---|
| 3,079,276 | 2/1963 | Puyear et al. | 117/107.2 |
| 3,257,230 | 6/1966 | Wachtell et al. | 117/107.2 |
| 5,458,664 | 10/1995 | Ishii et al. | 55/282 |
| 5,505,757 | 4/1996 | Ishii | 55/523 |

FOREIGN PATENT DOCUMENTS

| | | |
|---|---|---|
| 0639398 | 2/1995 | European Pat. Off. . |
| 410579 | 10/1966 | Switzerland . |

OTHER PUBLICATIONS

Patent Abstracts of Japan, vol. 14, No. 7 (C–673), Jan. 10, 1990 & JP–A–01 255686 (Sumitomo Electric Ind) Oct. 12, 1989.

Patent Abstracts of Japan, vol 12., No. 318 (E–650), Aug. 29, 1988 & JP–A–63 081767 (Matsushita Electric Ind et al.) Apr. 12, 1988.

Rapp, "The Codeposition of Elements in Diffusion Coatings by the Pack Cementation Method", Materials at High Temperatures, vol. 11, No. 1/4/1993, Jordan Hill, Oxford, GB, pp. 181–184.

*Primary Examiner*—Scott Kastler

*Attorney, Agent, or Firm*—Wenderoth, Lind & Ponack, L.L.P.

[57] ABSTRACT

In manufacturing a corrosion-resistant metallic porous member having high Cr content by diffusion process in which the material is heat-treated, a plurality of heat cycles are used to achieve uniform Cr content in the thickness direction. Metallic porous body of Ni, Fe, Ni-Cr or Fe-Cr is buried in a powder of Al, Cr and $NH_4Cl$. Inert gas such as Ar and $H_2$ is introduced and the porous body is heat treated at 800°–1100° C. In the heat treatment, at least two temperature-increase and temperature-decrease steps are included.

3 Claims, 2 Drawing Sheets

CORROSION-RESISTANT METALLIC POROUS MEMBER AND METHOD OF MANUFACTURING THE SAME

This is a divisional application of Ser. No. 08/493,461 filed Jun. 22, 1995 now U. S. Pat. No. 5,582,867.

BACKGROUND OF THE INVENTION

This invention relates to a corrosion-resistant porous metallic member whose pores communicate with each other and which can be used as a material for various kinds of filters, especially corrosion-resistant, heat-resistant filters and catalyst carriers, and a method of manufacturing the same.

Unexamined Japanese Patent Publications 1-255686 and 63-81767 disclose pure-nickel porous members which are used as materials for battery electrodes. The methods for manufacturing such porous members disclosed in these publications comprise the steps of depositing a metal by electroplating on a conductive unwoven fabric or an unwoven fabric subjected to conductivity-imparting treatment, and heating the plated fabric to remove the fabric core body and at the same time increase the density of the metal structure. Examined Japanese Patent Publications 42-13077 and 54-42703 disclose stainless porous filter members manufactured by forming an unwoven fabric of metallic fibers obtained by drawing and cutting, and then sintering it.

In the method disclosed in the first publication, a metal layer is formed by electroplating on a conductive, three-dimensional, reticular, porous resin substrate by bringing it into tight contact with a cathode in a plating bath, the cathode being in the form of exposed spots studded on a conductor which is insulated except its exposed cathode spots.

The metallic porous member formed by this method has a balanced weight distribution in its thickness direction. Before this method was developed, it was impossible to provide a metallic porous member having such a uniform weight distribution in a thickness direction.

The battery electrode disclosed in the second publication is manufactured by the steps of: imparting conductivity to a strip of non-conductive resin or unwoven fabric having a three-dimensional reticular structure; moving the strip as a cathode in a plating bath while pressing its one side against a feed electrode to form a secondary conductive layer in the form of a metal plated layer on the surface of the strip; forming metal plated layers of a predetermined thickness on both sides of the strip as a cathode, cutting the strip to a predetermined shape, and winding the strip with its side pressed against the feed electrode in the plating bath facing inside.

Before this publication, it was difficult to provide a uniform electrocoating layer in the pores of a non-conductive porous member due to a difference in current density between its surface and inner portion. This publication tried to solve this problem.

The third publication discloses a method of manufacturing a filter element, which comprises the steps of drawing a metal wire to an extremely small diameter, annealing it in a furnace kept in a non-oxidizing atmosphere, cutting it to a suitable lengths, forming the thus cut wires into an unwoven fabric, and sintering the fabric under pressure in a reducing atmosphere.

This publication aims to provide a filter element which has high shock resistance and strength and which can be manufactured with a smaller number of steps.

The fourth publication discloses a method of manufacturing a reinforced metal filter. In this method, a reinforced metal filter is formed by placing a mass of square stainless steel filaments in an oxygen-free atmosphere or in a vacuum, compressing the entire mass flatly at a constant pressure while heating it to collapse the filaments along the ridgelines of the joint portions between the filaments and thus to partially increase the joint area corresponding to the pressure applied, and hardening the entire mass while controlling the area of the pores formed between the filaments due to intermetallic diffusion at joint area.

This publication aims to reduce the number of manufacturing steps and provide a product high in heat efficiency while suitably controlling the porosity of the filter member.

In the first method, only a limited kinds of metals can be deposited by plating. It is impossible to form a sufficiently corrosion-resistant and heat-resistant alloy which can withstand a temperature of more than 500° C., such as Ni-Cr or Ni-Cr-Al alloy, which the applicant of this invention proposed in Unexamined Japanese Patent Publication 5-206255), or Fe-Cr or Fe-Cr-Al alloy, which is now gathering attention as materials for catalyst carriers for treating gasoline engine emissions. In the second method, it is impossible to form metal fiber. Thus, the article obtained in this method loses its heat resistance and corrosion resistance at 600° C. or over.

In order to solve the problems of these two methods, it has been proposed to use these two methods in conjunction with what is known as a powder diffusion method for preparing an alloy composition which is used to provide a corrosion-resistant coating on a car body or the like. Namely, in this method, a metallic porous member prepared by either of the above two methods is buried in a powder containing Al, Cr and $NH_4Cl$, and heated at 800°–1100° C. to adjust the alloy composition by depositing and diffusing Cr and Al to obtain a sufficiently heat-resistant and corrosion-resistant alloy.

If the mutually communicating pores in the alloy thus formed have a diameter smaller than 100 $\mu$m, the distribution of composition of the porous member tends to be large in a thickness direction. If its thickness is 1 mm or more, the content at its center with respect to the thickness direction may be one-tenth or less of the content at its outermost area. If the Cr and/or Al content is increased to increase the heat resistance and corrosion resistance so that the alloy can withstand a temperature of 700° C. or higher even at its central portion, the toughness of the alloy tends to be low. This impairs the formability and resistance to vibration, which will, after all, makes it impossible to obtain a heat-resistant and corrosion-resistant material which can withstand a temperature higher than 700° C.

Another problem with Ni-Cr-Al alloy and Fe-Cr-Al alloy is that if the amount of Al is increased to increase the heat resistance of the alloy, its toughness tends to decrease correspondingly, thus lowering formability. This makes it necessary to adjust the alloy composition after forming a metallic porous member made of Ni, Fe, Ni-Cr or Fe-Cr into a predetermined shape. According to the final shape of the porous member, it may be necessary to use a technique for diffusing components uniformly in the thickness direction. But if the metallic porous member is alloyed with Cr and Al simultaneously by the powder diffusion method, in which Cr and Al powders are mixed, the Cr content tends to be insufficient since the vapor pressure of Cr is lower than that of Al. Also, the Cr content tends to be uneven, especially in the thickness direction. The metallic member thus formed tends to be too low in corrosion resistance at its central portion.

An object of the present invention is to provide a heat-resistant, corrosion-resistant metallic porous member which is free of these problems and a method of manufacturing such a porous member.

SUMMARY OF THE INVENTION

According to this invention, there is provided a method of manufacturing a corrosion-resistant metallic porous member comprising the steps of providing a metallic porous member of a metal or metal alloy having a heat resistance higher than 500° C. and a corrosion resistance, burying the porous member in a powder containing Al, Cr and $NH_4Cl$ or their compound, and subjecting the porous member to heat treatment at temperatures suitable for the metal or metal alloy in an inert gas atmosphere or in a gas whose components are the same as those of a gas produced when heating the porous member, the heat treatment comprising at least two heating cycles each including heat increase and heat decrease.

In the method of manufacturing a metallic porous member according to the present invention, a metallic porous member made of such a metal or metal alloy as Ni, Fe, Ni-Cr, or Fe-Cr is prepared beforehand, and buried in a powder containing Al, Cr and $NH_4Cl$, or their compound, and heated by powder diffusion method . In the powder diffusion method using Cr and Al powders, it-is impossible to alloy a sufficient amount of Cr with the porous member because the Cr vapor pressure is lower than the Al vapor pressure. We have found out that Cr deposition reaction occurs when the temperature is decreased with the vapor supersaturated with Cr. Thus, in the present invention, in order to promote the Cr deposition, more than one temperature-decreasing step is carried out during the heating.

During such temperature-decreasing step, it is not necessary to reduce the temperature to room temperature as shown in FIG. 3A. Expected results are achievable by reducing the temperature only slightly and then increasing it as shown in FIG. 3B. The Cr content should be determined so that the porous member is sufficiently heat-resistant and corrosion-resistant as a filter. It should preferably be 15–35% by weight.

From a productivity viewpoint, the number of such temperature-decrease should be as small as possible for higher manufacturing efficiency and lower manufacturing cost. Thus, it should be two to three, at which it is possible to increase the Cr content to minimum requirement level. Since Cr deposition occurs every time the heating temperature drops, it is possible to increase the Cr content uniformly in the thickness direction of the metallic porous member by subjecting the porous member to heat treatment only once. Since it is possible to adjust the Al and Cr contents uniformly in the thickness direction of the metallic porous member, it is possible to insure its heat resistance and corrosion resistance, as far as to its inner portion.

The frame forming the porous member should have a thickness of 50–80 $\mu$m with pores having a diameter between 0.1–0.5 mm. If the pore diameter is larger than 0.5 mm, the collecting capacity as a filter will become low. If smaller than 0.1 mm, the filter tends to clog soon, making prolonged use difficult. If the frame thickeness is less than 50 m, the porous member will yield to the exhaust pressure easily. If thicker than 80 $\mu$m, it is difficult to alloy the frame to the inner part, so that the corrosion resistance would be low.

The metallic porous member should be an unwoven fabric having a fiber diameter of 5–40 $\mu$m and the packing density of 3–20%. For higher capacity of collecting particulates in exhaust gas, it is desirable to use finer fibers and pack it with high packing density. But if the fiber diameter is less than 5 $\mu$m, the durability of the filter will be low. If the packing density is higher than 20% and/or the average diameter is larger than 40 $\mu$m, this will lead to increased possibility of clogging and increased pressure loss.

The metallic porous member should have a thickness of 1–10 mm. For higher collecting capacity, the use of a thicker porous member is preferable because the thicker the porous member, the larger the filtering area. But a porous member thicker than 10 mm is not desirable because extra electric power is required to regenerate such a thick filter.

The fifth to seventh claims concern metallic porous members obtained by the method of the present invention method. In any of them, the Al content should be not less than 1%. Otherwise, the heat resistance and oxidation resistance will scarcely improve. More than 15% Al will impair formability.

Al plays a main role in the oxidation resistance. Even if the Al content is 1–15%, if the Cr content is less than 10%, the bond strength and protective properties of the film formed tends to be so low that the oxidation resistance will be insufficient. Addition of more than 40% Cr will lead to reduced toughness even if the Al content is within the range of 1–15%. This is true if the balance is Fe.

Other features and objects of the present invention will become apparent from the following description made with reference to the accompanying drawings, in which;

DETAILED DESCRIPTION OF THE PREFERRED EMBODIMENT

Figure 1:
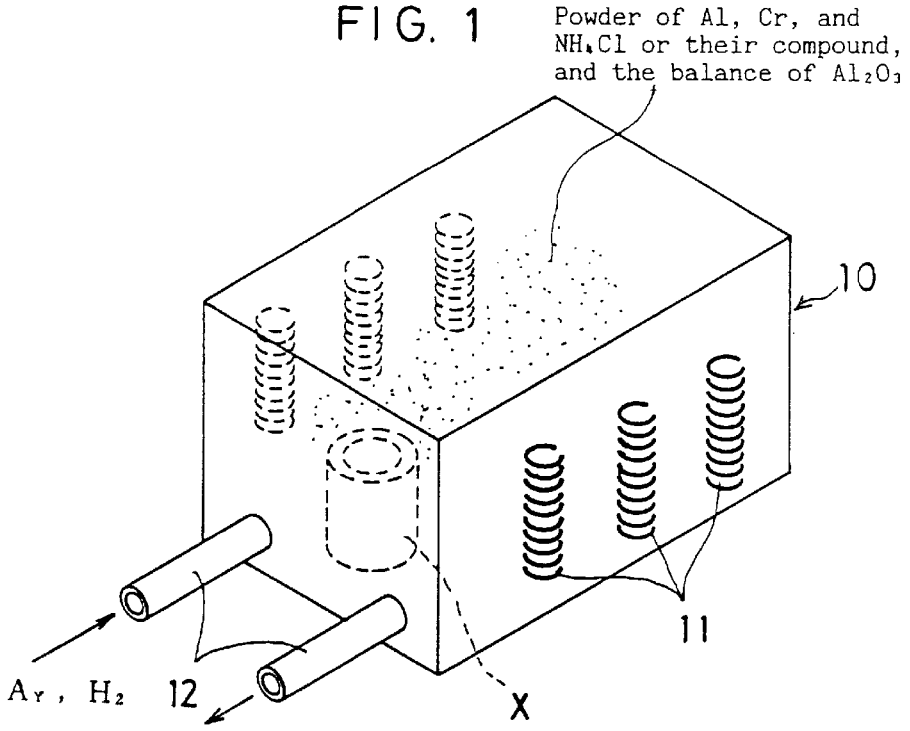
FIG. 1 is a schematic view of a heating furnace used in the examples of the present invention.

Now we will describe examples of the invention. FIG. 1 is a schematic view of a heating furnace 10 used in carrying out the method of this invention. It has heaters 11 and inlet/discharge pipes 12 for inert gas such as Ar or H2. Al, H2 or $NH_4Cl$ powder is kept in a sealed state in the furnace beforehand, together with a metallic porous member X of Ni, Fe, Ni-Cr or Fe-Cr. As a first step of the method of the invention, the metallic porous member X is buried in a powder containing Al, Cr and $NH_4Cl$ or their compound. Then, the member X is heated at 800°–1100° C. in an atmosphere of an inert gas such as Ar or H2, or in a gas whose composition are the same as those of a gas produced when the above powder is heated at 800°–1100° C. During this heating step, the cycle of increasing the heating temperature from 800° C. to 950° C. and reducing it from 950° C. to 800° C. is repeated at least twice. (This cycle is hereinafter referred to as "heat cycle".)

Figure 2B:
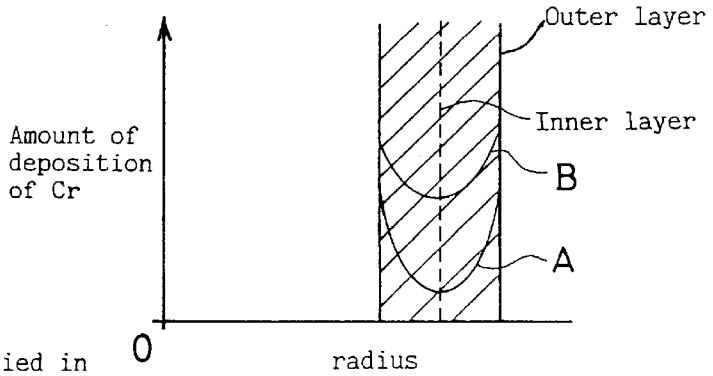
FIGS. 2A, 2B are views showing the operation of the present invention.
Figure 2A:
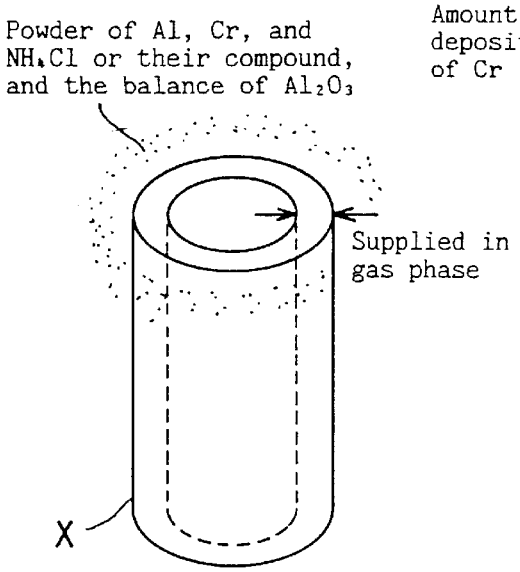

As shown in FIGS. 2, the metallic porous member X is placed in the powder of Al+Cr+$NH_4Cl$+balance of $Al_2O_3$. In this state, the inert gas pressure acts on the inner and outer surfaces of the member X, so that Cr and Al diffuse into the member. By repeating the heat cycle at least twice, the deposition of Cr proceeds from the state shown by curve A in FIG. 2B to the state shown by curve B. The balance of $Al_2O_3$ does not contribute the reaction in any way.

Figure 3A:
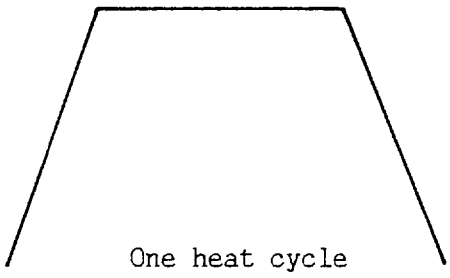
FIGS. 3A, 3B and 3C are graphs showing heat cycles of different patterns.
Figure 3B:
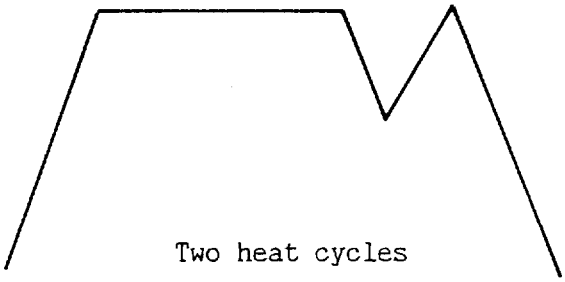
Figure 3C:
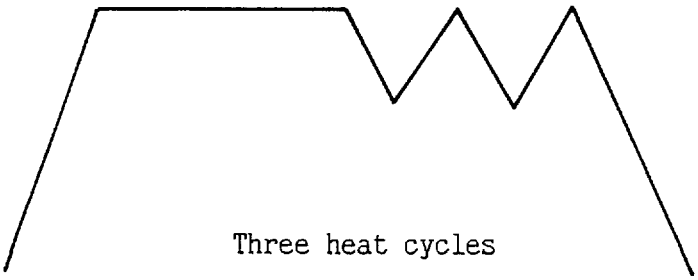

We will now explain the results of several experiments. In these experiments, we prepared a specimen comprising five Ni metallic porous layers each 1.8 mt thick, the packing density being 5%. After alloying the specimen by subjecting them to the heat-cycle treatment, it was cut to 1×1 cm pieces. Then, the layers of each test piece were peeled off one by one from the outermost layer to analyze the composition of metallic porous member by ionization absorbance analysis. (Experiment 1) The metallic porous member was subjected to diffusion treatment for five hours at 1050° C. in Ar atmosphere, using a diffusing agent comprising Al: 1% by weight, Cr: 50% by weight, $NH_4Cl$: 0.5% by weight, the balance being alumina. FIG. 3A shows the heat pattern in this experiment. (Experiment 2) We used the same powder used in Experiment 1. In this experiment, the heat pattern shown in FIG. 3B was used. We measured the Cr concentration of each layer. (Experiment 3) We used the same powder used in Experiment 1. In this experiment, the heat pattern shown in FIG. 3C was used. We measured the Cr concentration of each layer.

The results of these experiments are shown in Table 1.

(Control Example 1)

We prepared a specimen comprising ten Ni metallic porous layers each 1.8 mt thick, the packing density being 5%. The specimen was alloyed by subjecting them to the same heat-cycle treatment used in Experiments 1–3. The results of the experiment are shown in Table 2. In this case, since the filter thickness exceeded 10 mm, the Cr content was low in the inner portion, so that the heat resistance was low. (Experiment 2) The metallic porous member was subjected to diffusion treatment using a diffusing agent having a composition comprising Al: 1% by weight, Cr: 35% by weight, $NH_4Cl$: 0.5% by weight, the balance being alumina. In this experiment, we used a specimen comprising five Ni metallic porous layers each 1.8 mt thick, the packing density being 5%. The specimen was alloyed by subjecting them to the same heat-cycle treatment employed in Experiments 1 and 2. The results of this experiment are shown in Table 3. (Control Example 2) In this example, we increased the number of layers to 10 while r of layers ayers was increased to 10 while using the same powder used in Example 2. The results are shown in Table 3.

In this case, since the filter thickness exceeded 10 mm, the Cr content was low in the inner portion, so that the heat resistance was low.

TABLE 1

| Heat cycle | | Composition (in wt %) Al | Cr | Ni | Thermo-gravity increase (%) | Number of bendings | *1 Overall judge-ment |
|---|---|---|---|---|---|---|---|
| 1st | 1st layer | 0.8 | 21.6 | balance | 20 | 8 | X |
| | 3rd layer | 2.3 | 7.6 | balance | | | |
| 2nd | 1st layer | 3.1 | 21.9 | balance | 15 | 8 | X |
| | 3rd layer | 4 | 12.7 | balance | | | |
| 3rd | 1st layer | 1.3 | 25.3 | balance | 8 | 6 | ○ |
| | 3rd layer | 2 | 19.7 | balance | | | |

*1 ○ indicates that heat resistance was 10% or lower and resistance to bending was three times or over.

TABLE 2

| Heat cycle | | Composition (in wt %) Al | Cr | Ni | Thermo-gravity increase (%) | Number of bendings | *1 Overall judge-ment |
|---|---|---|---|---|---|---|---|
| 1st | 1st layer | 1.2 | 15.4 | balance | 25 | 9 | X |
| | 3rd layer | 2.2 | 0.9 | balance | | | |
| | 5th layer | 1.8 | 0.4 | balance | | | |
| 2nd | 1st layer | 1.2 | 20.2 | balance | 20 | 8 | X |
| | 3rd layer | 2.7 | 7.0 | balance | | | |
| | 5th layer | 2.3 | 6.5 | balance | | | |
| 3rd | 1st layer | 1.2 | 22 | balance | 15 | 6 | X |
| | 3rd layer | 2.7 | 10.2 | balance | | | |
| | 5th layer | 2.7 | 8.5 | balance | | | |

TABLE 3

| Heat cycle | | Composition (in wt %) Al | Cr | Ni | Thermo-gravity increase (%) | Number of bendings | *1 Overall judge-ment |
|---|---|---|---|---|---|---|---|
| 1st | 1st layer | 3 | 19.8 | balance | 15 | 8 | X |
| | 3rd layer | 3.5 | 12.0 | balance | | | |
| 2nd | 1st layer | 4.0 | 20.8 | balance | 6 | 4 | ○ |
| | 3rd layer | 4.0 | 19.0 | balance | | | |

*1 ○ indicates that heat resistance was 10% or lower and resistance to bending was three times or over.

TABLE 4

| Heat cycle | | Composition (in wt %) Al | Cr | Ni | Thermo-gravity increase (%) | Number of bendings | *1 Overall judge-ment |
|---|---|---|---|---|---|---|---|
| 1st | 1st layer | 2.5 | 11.8 | balance | 22 | 8 | X |
| | 3rd layer | 3 | 4.9 | balance | | | |
| | 5th layer | 4 | 2.9 | balance | | | |
| 2nd | 1st layer | 3.6 | 12.8 | balance | 15 | 6 | X |
| | 3rd layer | 3.8 | 8.5 | balance | | | |
| | 5th layer | 3.8 | 7 | balance | | | |

What is claimed is:

1. A corrosion-resistant metallic porous member manufactured by a method comprising the steps of providing a metallic porous member of a metal or metal alloy selected from the group consisting of Ni, Fe, Ni-Cr and Fe-Cr having a heat resistance higher than 500° C. and a corrosion resistance, burying said porous member in a powder containing Al, Cr and $NH_4Cl$ or their compound, and subjecting said porous member to heat treatment at temperatures suitable for said metal or metal alloy in an inert gas atmosphere or in a gas whose components are the same as those of a gas produced by the powder when heating said porous member to vapor diffuse aluminum and chromium into the porous member, said heat treatment comprising at least two heat cycles to provide a thickness of 1–10 mm to the metallic porous member, each heat cycle including heat increase and heat decrease wherein the heat decrease step occurs when the vapor is supersaturated with chromium, thereby promoting chromium diffusion, said porous member comprising 5–20% by weight of Ni 10–40% by weight of Cr 1–15% by weight of Al, and the balance being Fe and inevitable components.

2. A corrosion-resistant metallic porous member manufactured by a method comprising the steps of providing a metallic porous member of a metal or metal alloy selected from the group consisting of Ni, Fe, Ni-Cr and Fe-Cr having a heat resistance higher than 500° C. and a corrosion resistance, burying said porous member in a powder containing Al, Cr and $NH_4Cl$ or their compound, and subjecting said porous member to heat treatment at temperatures suitable for said metal or metal alloy in an inert gas atmosphere or in a gas whose components are the same as those of a gas produced by the powder when heating said porous member to vapor diffuse aluminum and chromium into the porous member, said heat treatment comprising at least two heat cycles to provide a thickness of 1–10 mm to the metallic porous member, each heat cycle including heat increase and heat decrease wherein the heat decrease step occurs when the vapor is supersaturated with chromium, thereby promoting chromium diffusion, said porous member comprising 10–40% by weight of Cr, 1–15% by weight of Al, and the balance being Ni and inevitable components.

3. A corrosion-resistant metallic porous member manufactured by a method comprising the steps of providing a metallic porous member of a metal or metal alloy selected from the group consisting of Ni, Fe, Ni-Cr and Fe-Cr having a heat resistance higher than 500° C. and a corrosion resistance, burying said porous member in a powder containing Al, Cr and $NH_4Cl$ or their compound, and subjecting said porous member to heat treatment at temperatures suitable for said metal or metal alloy in an inert gas atmosphere or in a gas whose components are the same as those of a gas produced by the powder when heating said porous member to vapor diffuse aluminum and chromium into the porous member, said heat treatment comprising at least two heat cycles to provide a thickness of 1–10 mm to the metallic porous member, each heat cycle including heat increase and heat decrease wherein the heat decrease step occurs when the vapor is supersaturated with chromium, thereby promoting chromium diffusion, said porous member comprising 10–40% by weight of Cr, 1–15% by weight of Al, and the balance being Fe and inevitable components.

* * * * *